US011174587B2

(12) United States Patent
Bensel et al.

(10) Patent No.: US 11,174,587 B2
(45) Date of Patent: Nov. 16, 2021

(54) HEATER ASSEMBLY FOR AN APPLIANCE HAVING ONE OR MORE HOUSING-SECURING FEATURES

(71) Applicant: Haier US Appliance Solutions, Inc., Wilmington, DE (US)

(72) Inventors: Peter Hans Bensel, Louisville, KY (US); Christopher Gene Vowels, Cox's Creek, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 176 days.

(21) Appl. No.: 16/401,327

(22) Filed: May 2, 2019

(65) Prior Publication Data

US 2020/0347541 A1 Nov. 5, 2020

(51) Int. Cl.
*D06F 58/26* (2006.01)
*D06F 58/02* (2006.01)

(52) U.S. Cl.
CPC ..... *D06F 58/26* (2013.01); *D06F 58/02* (2013.01)

(58) Field of Classification Search
CPC ..... D06F 5/02; D06F 58/26
See application file for complete search history.

(56) References Cited

U.S. PATENT DOCUMENTS 3,898,784 A * 8/1975 Sauer ..... F16B 7/22 403/327
4,025,754 A * 5/1977 Marzonie ..... D06F 58/26 219/400
4,165,944 A * 8/1979 Sunasky ..... A47B 57/402 403/254
5,334,818 A * 8/1994 Edwards ..... F24H 3/0405 219/537
5,925,273 A 7/1999 Sherrill
6,173,765 B1 * 1/2001 Uchikawa ..... F28F 9/02 165/173
9,869,053 B2 1/2018 James et al.
(Continued)

FOREIGN PATENT DOCUMENTS

CA 2409537 C 4/2004
CA 2410001 A1 4/2004
(Continued)

*Primary Examiner* — Jorge A Pereiro
*Assistant Examiner* — Logan P Jones
(74) *Attorney, Agent, or Firm* — Dority & Manning, P.A.

(57) ABSTRACT

A dryer appliance may include a cabinet, a drum, and a heater assembly. The heater assembly may include a housing, a first mounting flange, a second mounting flange, and a slide clamp. The housing may include a first housing portion and a second housing portion defining a chamber, as well as an inlet and an outlet. The first mounting flange may extend radially from the first housing portion to define a first reference plane having a mutually-orthogonal vertical direction, lateral direction, and transverse direction. The second mounting flange may extend radially from the second housing portion and slidably positioned on the first mounting flange. The second mounting flange may define a clamp aperture extending therethrough along the vertical direction. The slide clamp may extend through the clamp aperture and generally along the transverse direction from a base end fixed to the first mounting flange to a distal free end.

18 Claims, 10 Drawing Sheets

(56) References Cited

U.S. PATENT DOCUMENTS

| | | | | |
|---|---|---|---|---|
| 2003/0089701 | A1 | 5/2003 | Lee | |
| 2008/0265728 | A1* | 10/2008 | Collins | A47B 47/0075 312/326 |
| 2010/0327127 | A1* | 12/2010 | Crane | A47L 15/486 248/68.1 |
| 2013/0042500 | A1* | 2/2013 | Hong | D06F 58/02 34/604 |
| 2014/0034631 | A1* | 2/2014 | James | F24H 9/0063 219/520 |

FOREIGN PATENT DOCUMENTS

| | | | | |
|---|---|---|---|---|
| EP | 0707996 | A1 * | 4/1996 | F28F 9/002 |
| KR | 100938655 | B1 | 1/2010 | |

* cited by examiner

HEATER ASSEMBLY FOR AN APPLIANCE HAVING ONE OR MORE HOUSING-SECURING FEATURES

FIELD OF THE INVENTION

The present subject matter relates generally to heater assemblies for an appliance, such as a dryer appliance.

BACKGROUND OF THE INVENTION

Dryer appliances generally include a cabinet with a drum rotatably mounted therein. Dryer appliances also generally include a heater assembly that passes heated air through the drum in order to dry moisture laden articles disposed within the drum. For instance, the heater assembly may include a housing that encloses one or more heating elements while permitting air to pass therethrough. The temperature of heated air generated by the heater assembly can be monitored and regulated with a thermostat. In particular, the thermostat can be configured to trip and terminate further temperature increases within the heater assembly at a set point or temperature (e.g., in order to hinder or prevent the heater assembly from overheating).

In conventional heater assemblies, portions of the housing or heating elements may be joined using traditional fasteners (e.g., screws, bolts, nuts, etc.). Nonetheless, this may present various drawbacks. For instance, multiple fasteners may add to the cost and complexity of the system. Furthermore it may be difficult to ensure correct alignment of the overall housing and heating elements therein. Variations in manufactured parts or the handling of such parts prior to assembly may cause portions of the heater assembly to be misaligned (e.g., such that gaps are left between walls of the housing). If left unaddressed, misalignments within or on the housing may lead to air or heat leaks during use. This, in turn, may detrimentally affect the efficiency and operation of the appliance. Moreover, even if the misalignments are corrected, the time and effort to make such corrections is generally undesirable. In certain cases, entire parts may become unusable.

As a result, it would be useful to have an appliance or heater assembly that addresses one or more of the above issues. In particular, it would be advantageous if a heater assembly included one or more features that aided in alignment or assembly (e.g., such that the process of assembly was made easier, more efficient, or more easily resulted in a suitable end product).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a heater assembly is provided. The heater assembly may include a housing, a first mounting flange, a second mounting flange, and a slide clamp. The housing may include a first housing portion and a second housing portion selectively secured to the first housing portion. The first and second housing portions may define a chamber. The first and second housing portions may also define an inlet and an outlet. The chamber may extend along an axial direction from the inlet to the outlet. The first mounting flange may extend radially from the first housing portion to define a first reference plane having a mutually-orthogonal vertical direction, lateral direction, and transverse direction. The transverse direction may be parallel to the axial direction. The second mounting flange may extend radially from the second housing portion and slidably positioned on the first mounting flange. The second mounting flange may define a clamp aperture extending therethrough along the vertical direction. The slide clamp may extend through the clamp aperture and generally along the transverse direction from a base end fixed to the first mounting flange to a distal free end. The base end may be positioned below the second mounting flange. The distal free end may be positioned above the second mounting flange.

In another exemplary aspect of the present disclosure, a dryer appliance is provided. The dryer appliance may include a cabinet, a drum, and a heater assembly. The cabinet may define an interior. The drum may be positioned within the interior. The drum may define a chamber for receipt of articles for drying. The heater assembly may be mounted within the cabinet in fluid communication with the drum to heat air thereto. The heater assembly may include a housing, a first mounting flange, a second mounting flange, and a slide clamp. The housing may include a first housing portion and a second housing portion selectively secured to the first housing portion. The first and second housing portions may define a chamber. The first and second housing portions may also define an inlet and an outlet. The chamber may extend along an axial direction from the inlet to the outlet. The first mounting flange may extend radially from the first housing portion to define a first reference plane having a mutually-orthogonal vertical direction, lateral direction, and transverse direction. The transverse direction may be parallel to the axial direction. The second mounting flange may extend radially from the second housing portion and slidably positioned on the first mounting flange. The second mounting flange may define a clamp aperture extending therethrough along the vertical direction. The slide clamp may extend through the clamp aperture and generally along the transverse direction from a base end fixed to the first mounting flange to a distal free end. The base end may be positioned below the second mounting flange. The distal free end may be positioned above the second mounting flange.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
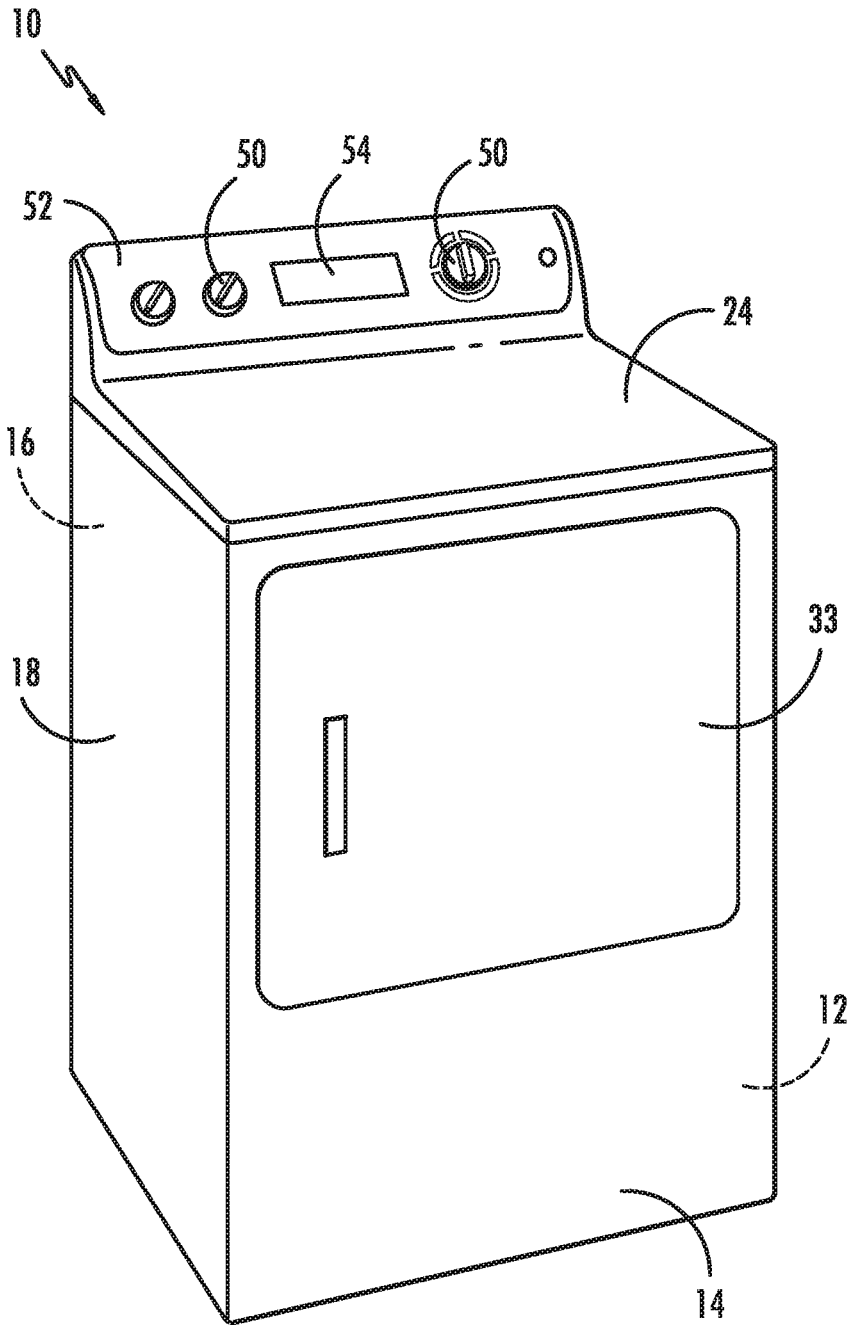
FIG. 1 provides a perspective view of a dryer appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
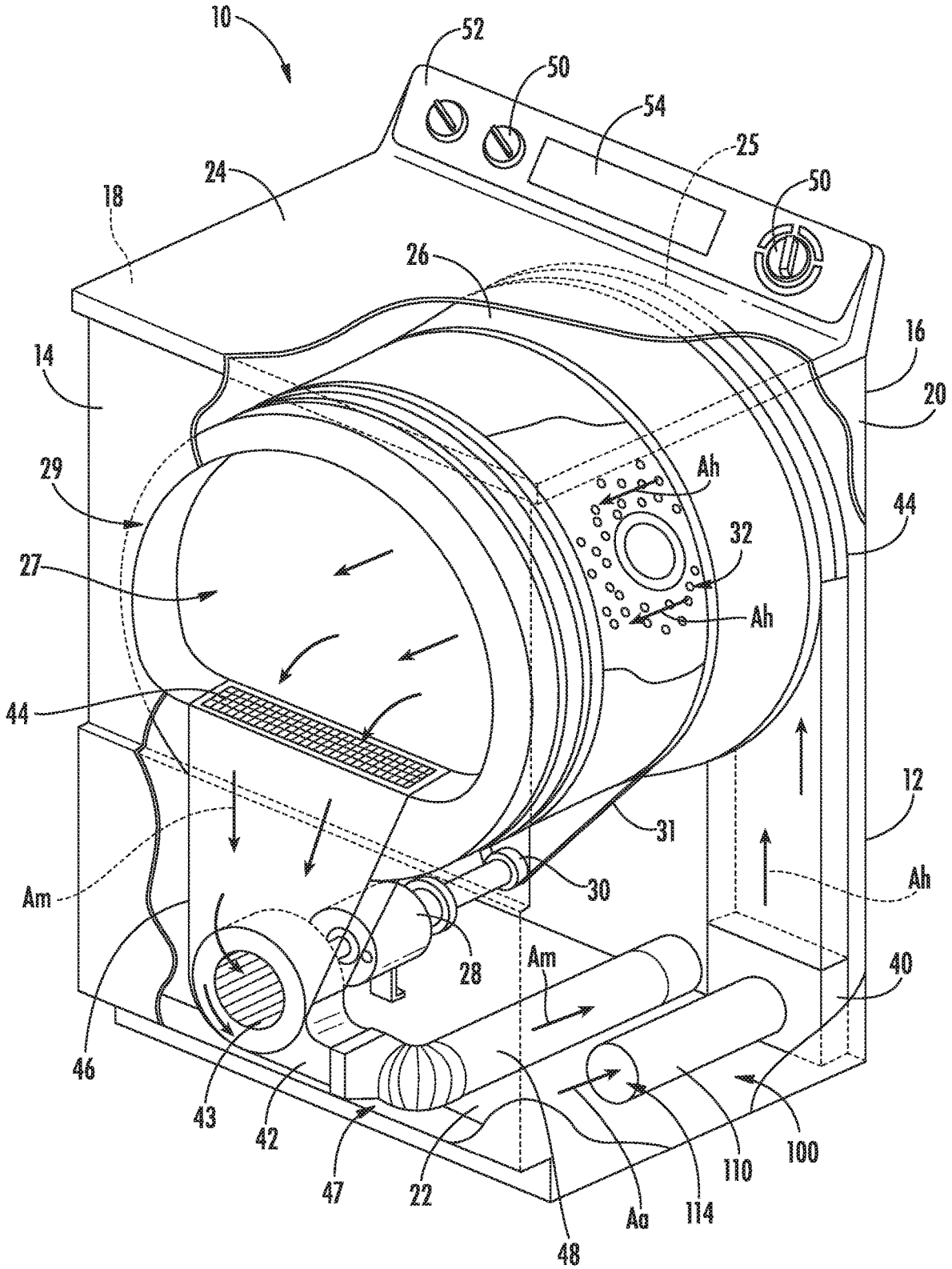
FIG. 2 provides a perspective view of the dryer appliance of FIG. 1 with a portion of the cabinet removed to reveal internal components of the dryer appliance.

Turning now to the figures, FIGS. 1 and 2 illustrate a dryer appliance 10 according to an exemplary embodiment of the present subject matter. While described in the context of a specific embodiment of dryer appliance 10, using the teachings disclosed herein it will be understood that dryer appliance 10 is provided by way of example only. Other dryer appliances having different appearances and different features may also be utilized with the present disclosure.

Dryer appliance 10 includes a cabinet 12 having a front panel 14, a rear panel 16, a pair of side panels 18 and 20 spaced apart from each other by front and rear panels 14 and 16, a bottom panel 22, and a top cover 24. Within cabinet 12 is a drum or container 26 mounted for rotation about a substantially horizontal axis. Drum 26 is generally cylindrical in shape and defines a chamber 27 for receipt of articles for drying. For example, dryer appliance 10 shown in FIGS. 1 and 2 is an electric dryer appliance with electrical heating elements. However, in alternative exemplary embodiments, dryer appliance 10 may be a gas dryer appliance with gas heating elements (e.g., gas burners) for heating air.

Drum 26 defines an opening 29 for permitting access to the chamber 27 of drum 26. Thus, opening 29 of drum 26 generally permits loading and unloading of clothing articles and other fabrics from chamber 27 of drum 26. A door 33 is rotatably mounted at opening 29 and selectively hinders access to chamber 27 of drum 26 through opening 29.

Drum 26 includes a rear wall 25 rotatably supported within cabinet 12 by a suitable fixed bearing. Rear wall 25 can be fixed or can be rotatable. A motor 28 rotates the drum 26 about the horizontal axis through a pulley 30 and a belt 31. Motor 28 is also in mechanical communication with an air handler 42 such that motor 28 rotates a fan assembly 43 (e.g., a centrifugal fan assembly) of air handler 42. Air handler 42 is configured for drawing air through chamber 27 of drum 26 (e.g., in order to dry articles located therein). In alternative exemplary embodiments, dryer appliance 10 includes an additional motor (not shown) for rotating fan assembly 43 of air handler 42 independently of drum 26.

Drum 26 is configured to receive heated air that has been heated by a heater assembly 100 (e.g., in order to dry damp articles disposed within chamber 27 of drum 26). Heater assembly 100 includes a housing 110. As discussed above, during operation of dryer appliance 10, motor 28 rotates drum 26 and fan assembly 43 of air handler 42 such that air handler 42 draws air through chamber 27 of drum 26 when motor 28 rotates fan assembly 43. In particular, ambient air, shown with arrow $A_a$, enters housing 110 of heater assembly 100 via an inlet 114 due to air handler 42 urging such ambient air $A_a$ into inlet 114. Such ambient air $A_a$ is heated within housing 110 and exits housing 110 as heated air, shown with arrow $A_h$, as discussed in greater detail below. Air handler 42 draws such heated air $A_h$ through a back duct 40 to drum 26. The heated air $A_h$ enters drum 26 through a plurality of holes 32 defined in rear wall 25 of drum 26.

Within chamber 27, the heat air $A_h$ can accumulate moisture (e.g., from damp articles disposed within chamber 27). In turn, air handler 42 draws moisture statured air, shown as arrow $A_m$, through a screen filter 44 which traps lint particles. Such moisture statured air $A_m$ then enters a front duct 46 and is passed through air handler 42 to an exhaust duct 48. From exhaust duct 48, such moisture statured air $A_m$ passes out of clothes dryer 10 through a vent 49 defined by cabinet 12.

In some embodiments, a cycle selector knob 50 is mounted on a cabinet backsplash 52 and is in communication with a controller 54. Signals generated in controller 54 operate motor 28 and heater assembly 100 in response to a position of selector knob 50. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or memory elements, such as electrically erasable, programmable read only memory (EEPROM).

Figure 3:
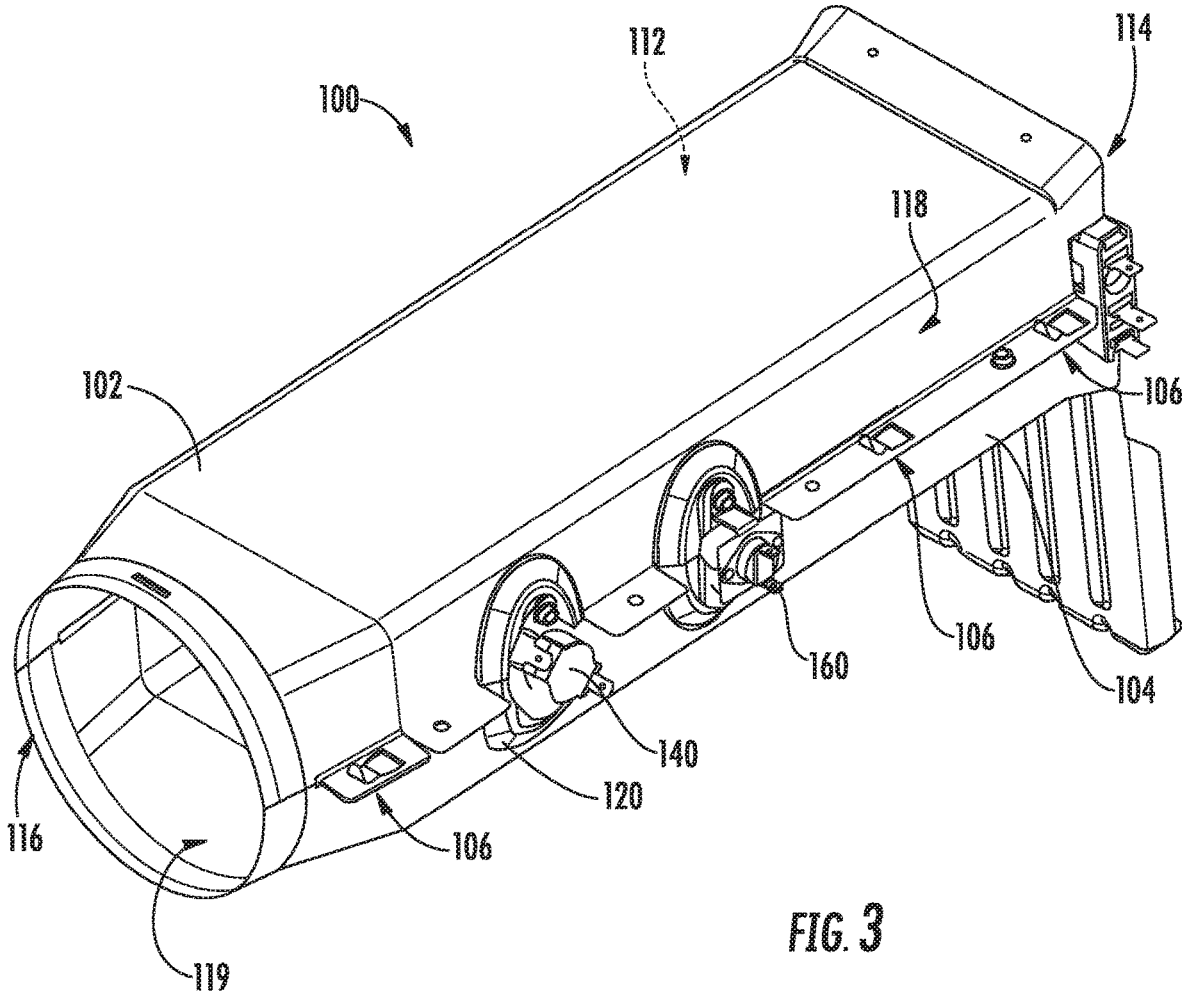
FIG. 3 provides a perspective view of a heater assembly of the exemplary dryer appliance of FIG. 2.

FIG. 3 provides a perspective view of heater assembly 100 and housing 110 removed from dryer appliance 10 (FIG. 1). As shown, housing 110 generally extends along an axial direction X and includes an upper housing portion 102 (e.g., second housing portion) and a lower housing portion 104 (e.g., first housing portion). Upper housing portion 102 and lower housing portion 104 may be selectively secured together via a clamping joint 106 to form housing 110, as will be discussed in greater detail below.

Generally, housing 110 (e.g., the assembled upper housing portion 102 and lower housing portion 104) defines a chamber 112. Housing 110 also defines inlet 114 and an outlet 116. In some embodiments, inlet 114 and outlet 114 are longitudinally spaced apart from one another (e.g., along the axial direction X) such that inlet 114 and outlet 114 are disposed on opposite ends of housing 110. The chamber 112 of housing 110 extends between inlet 114 and outlet 116 along the axial direction X such that inlet 114 and outlet 116 are in fluid communication via chamber 112. Thus, inlet 114 of housing 110 and outlet 116 of housing 110 may permit fluid (e.g., air) to flow longitudinally through chamber 112 of housing 110. For example, as discussed above, air handler 42 (FIG. 2) can draw ambient air $A_a$ into chamber 112 of housing 110 through inlet 114 of housing 110. Within chamber 112, such ambient air $A_a$ can be heated and exit chamber 112 of housing 110 through outlet 116 of housing 110 as heated air $A_h$.

When assembled, housing 110 also has an outer surface 118 and an inner surface 119. An embossment or projection 120 is mounted to housing 110 and extends away from outer surface 118 of housing 110. In some embodiments, a thermostat 140 is mounted to embossment 120. In further embodiments, an additional thermostat 160 is mounted to housing 110 upstream of thermostat 140.

In certain embodiments, thermostat 140 includes a support 144 (e.g., formed as a circular plate or as a plate having any suitable shape). A fastener 146 may extend through support 144 of thermostat 140 and into embossment 120 in order to mount thermostat 140 to embossment 120. Generally, thermostat 140 is configured for measuring a temperature of air within chamber 112 of housing 110. Thus, thermostat can include, for example, a thermocouple, thermistor, or resistance temperature detector. Thermostat 140 may be placed in communication with controller 54 (FIG. 1) such that controller 54 receives a voltage or current from thermostat 140 corresponding to the temperature of air within chamber 112 of housing 110. In particular, thermostat 140 includes a pair of blade connections 148 that may receive a wire or other suitable electrical conductor to place controller 54 and thermostat 140 in electrical communication.

Figure 4:
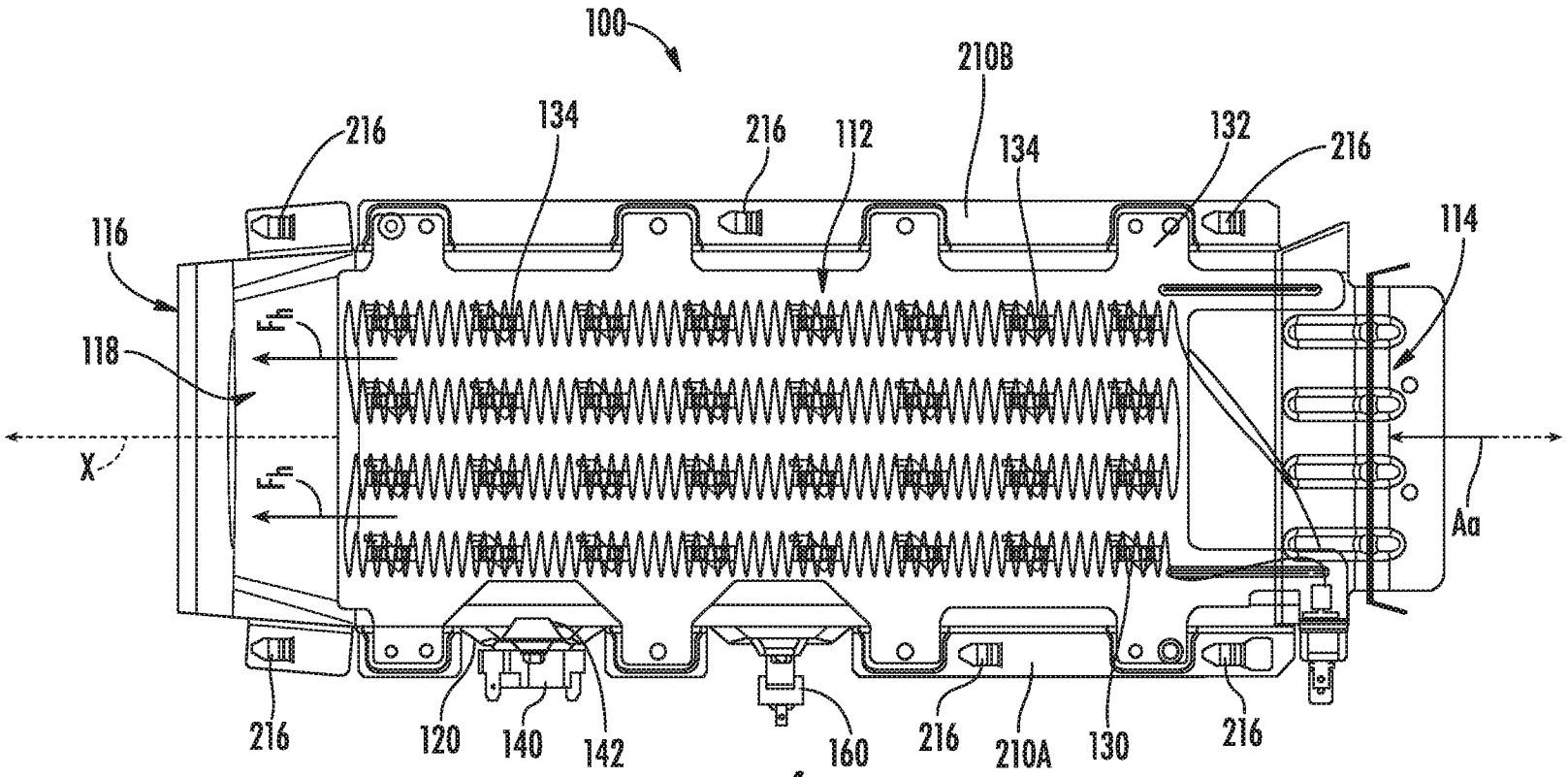
FIG. 4 provides a cross-sectional view of the exemplary heater assembly of FIG. 3.

FIG. 4 provides a cross-sectional view of heater assembly 100. As shown, in some embodiments, a heating element 130 is disposed within chamber 112 of housing 110. For instance, heating element 130 may be mounted to a plate 132 with brackets 134. In turn, plate 132 is mounted or secured to housing 110 between upper housing portion 102 (FIG. 2) and lower housing portion 104 (FIG. 2).

As may be seen in FIG. 4, thermostat 130 includes a probe 142. Probe 142 of thermostat 140 is positioned within chamber 112 of housing 110. Probe 142 of thermostat 140 may be exposed to air (e.g., heated air) within chamber 112 of housing 110. Thus, for example, a thermocouple within probe 142 of thermostat 140 can generate a voltage that corresponds to the temperature of the air within chamber 112 adjacent probe 142. Such voltage can be received by controller 63 (FIG. 1) in order to control dryer appliance 10 (FIG. 1) operations.

Heating element 130 is configured for heating air (e.g., ambient air $A_a$) that enters chamber 112 of housing 110 at inlet 114 of housing 110 in order to generate a flow of heated air, shown with arrows $F_h$. Flow of heated air $F_h$ exits chamber 112 of housing 110 at outlet 116 of housing 110 (e.g., as heated air $A_h$). In FIG. 4, heating element 130 is shown as an electrical resistance heating element. However, in alternative exemplary embodiments, heating element 130 may be any suitable type of heating element, such as a gas burner or combination of heating elements.

Figure 5:
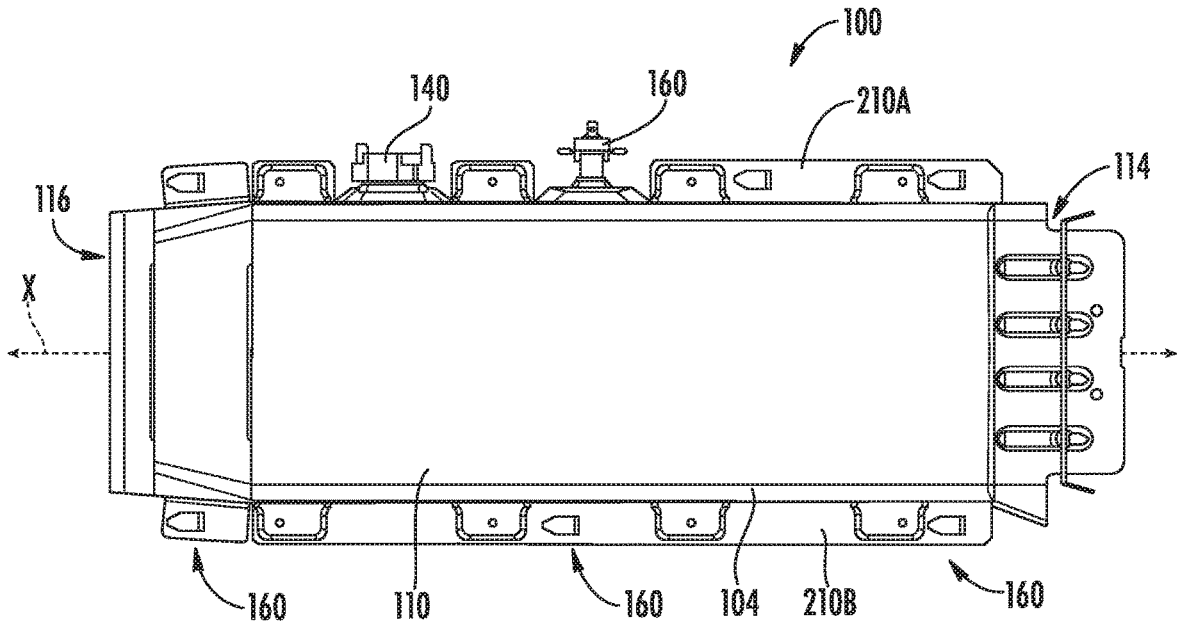
FIG. 5 provides a bottom perspective view of the exemplary heater assembly of FIG. 3.
Figure 6:
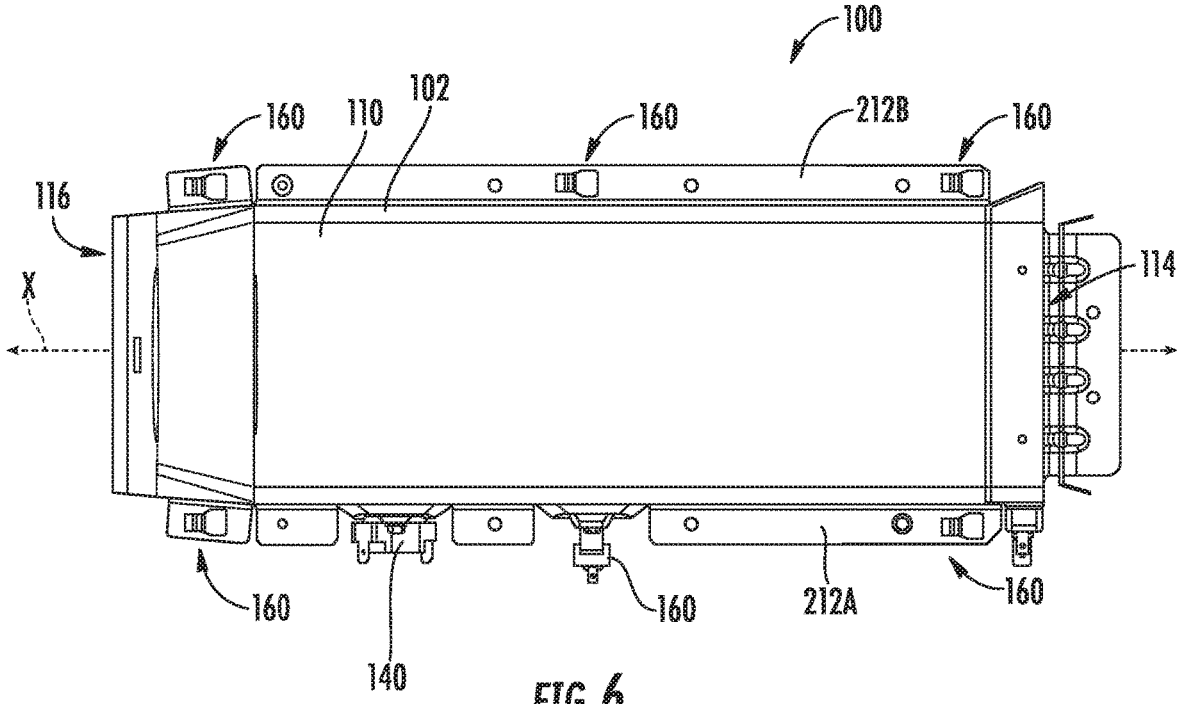
FIG. 6 provides a top perspective view of the exemplary heater assembly of FIG. 3.
Figure 7:
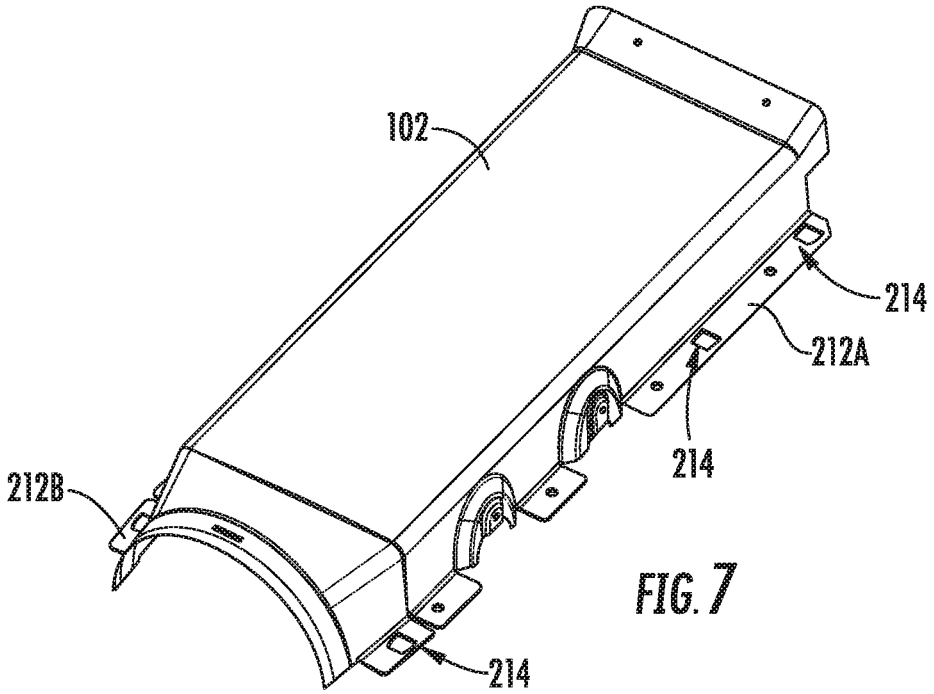
FIG. 7 provides a perspective view of an upper housing portion of the exemplary heater assembly of FIG. 3.
Figure 8:
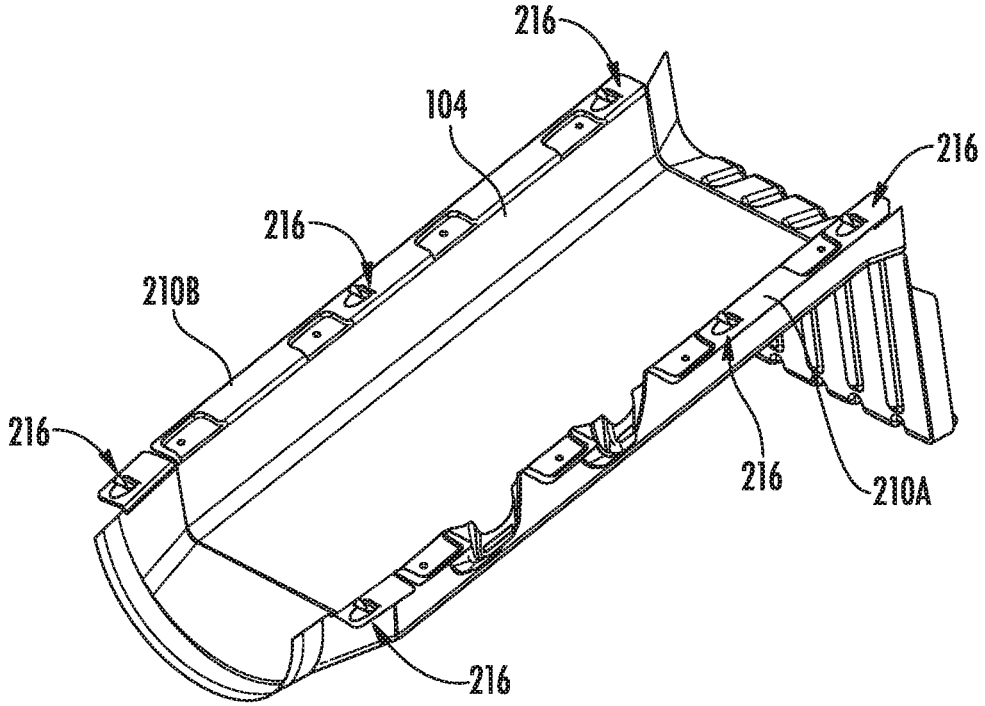
FIG. 8 provides a perspective view of a lower housing portion of the exemplary heater assembly of FIG. 3.

FIGS. 5 through 8 provide multiple views of various portions of heater assembly 100. Specifically, FIG. 5 provides a bottom perspective view of heater assembly 100. FIG. 6 provides a top perspective view of heater assembly 100. FIGS. 7 and 8 illustrate upper housing portion 102 and lower housing portion 104, respectively, in isolation.

As shown, upper housing portion 102 and lower housing portion 104 each provide a discrete mounting flange 210, 212 (e.g., held together in mated engagement when housing 110 is assembled) extending radially therefrom. Specifically, a first mounting flange 210 extends radially from lower housing portion 104 (e.g., radially outward from lower housing portion 104 relative to the axial direction X). A second mounting flange 212 extends radially from upper housing portion 102 (e.g., radially outward from upper housing portion 102 relative to the axial direction X). When assembled, first mounting flange 210 engages or contacts (e.g., directly contacts) second mounting flange 212 and the two are held together.

Generally, first mounting flange 210 defines a radial reference plane P (e.g., at an upper surface thereof) that has a mutually-orthogonal vertical direction V, lateral direction L, and transverse direction T. Specifically, the reference plane P may be defined on the lateral direction L in the transverse direction T, while the vertical direction V is understood to be perpendicular relative to the reference plane P. In some such embodiments, the transverse direction T is parallel to the axial direction X. When assembled, second mounting flange 212 may be generally parallel to first mounting flange 210 and thus include a surface that is parallel to the radial reference plane P. In certain embodiments, each housing portion 102, 104 includes a pair of mounting flanges 210, 212 (e.g., at opposite sides of the corresponding housing portion 102 or 104). In the illustrated embodiments, lower housing portion 104 includes a left first mounting flange 210A and a right first mounting flange 210B. Similarly, upper housing portion 102 includes a left second mounting flange 212A and a right second mounting flange 212B.

Together, the first and second mounting flanges 210, 212 form one or more clamping joints 106. For instance, the left first mounting flange 210A and the left second mounting flange 212A may form a plurality of discrete clamping joints 106. Additionally or alternatively, the right first mounting flange 210B and the right second mounting flange 212B may form a plurality of discrete clamping joints 106.

Generally, a clamping joint 106 includes a clamp aperture 214 and a corresponding slide clamp 216. In the illustrated embodiments, second mounting flange 212 defines at least one clamp aperture 214 that, when assembled, extends along the vertical direction V through second mounting flange 212. First mounting flange 210 provides a slide clamp 216 that, when assembled, extends from first mounting flange 210 and through clamp aperture 214 to hold the first and second mounting flanges 210, 212 together.

Figure 9:
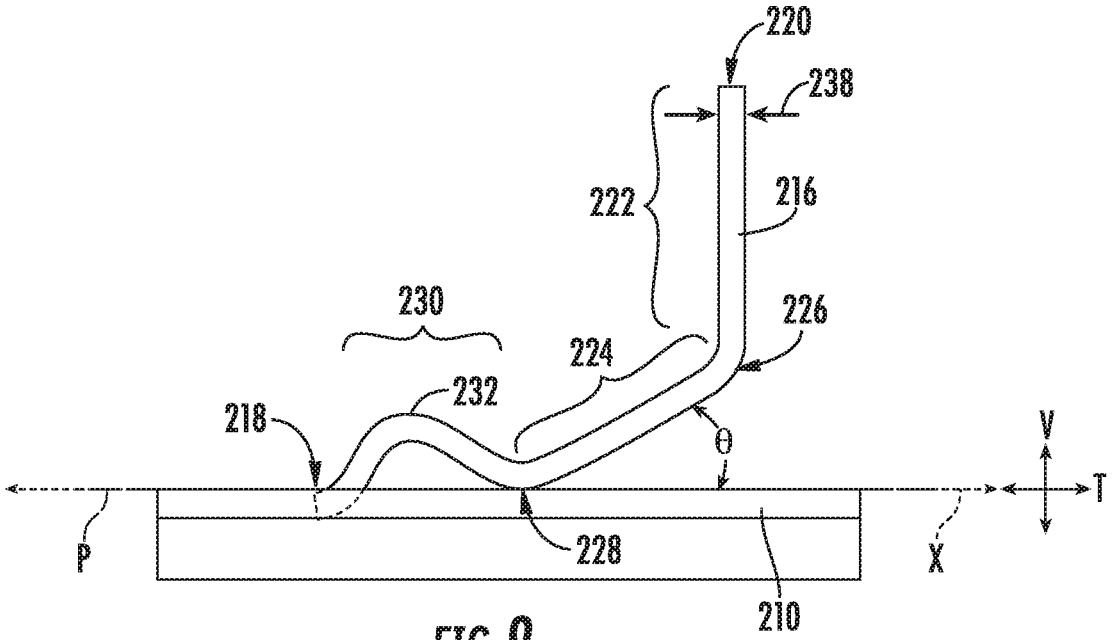
FIG. 9 provides a side perspective view of a first mounting flange, in isolation, of the exemplary heater assembly of FIG. 3.
Figure 10:
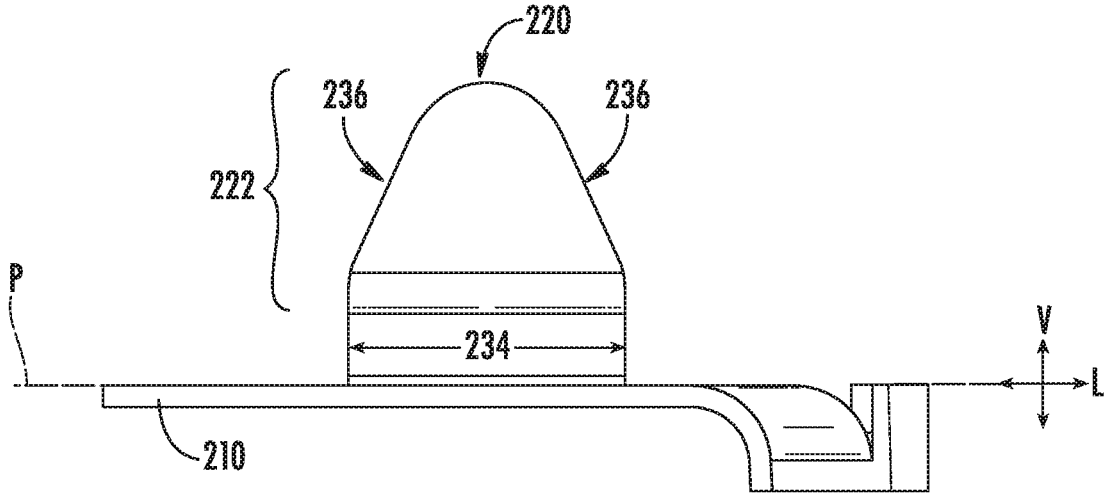
FIG. 10 provides a front perspective view of the first mounting flange, in isolation, of the exemplary heater assembly of FIG. 3.
Figure 14:
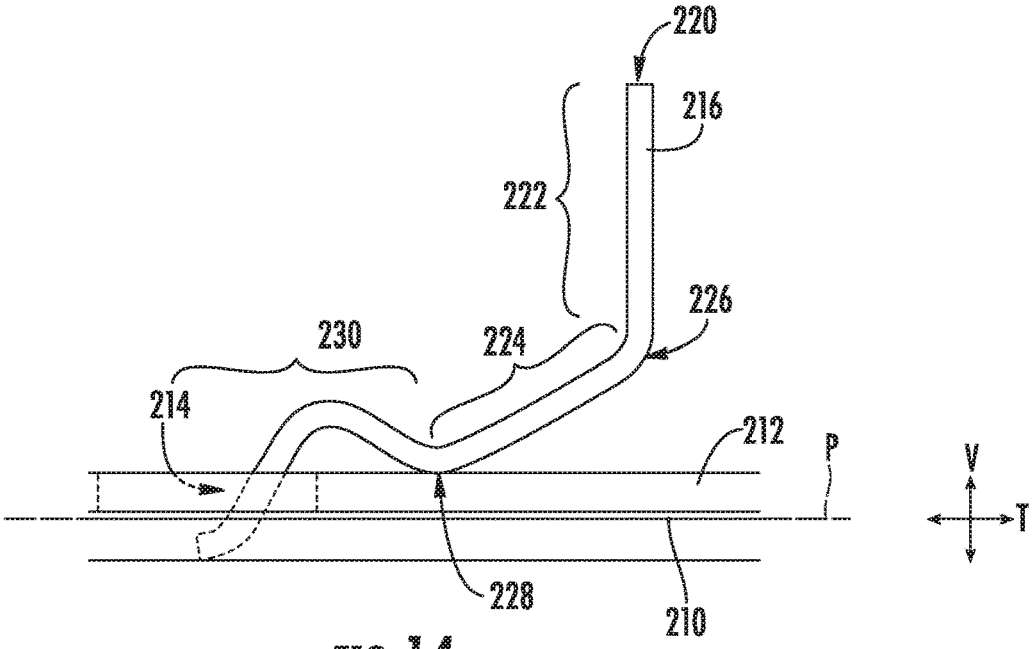
FIG. 14 provides a side perspective view of a first mounting flange and second mounting flange in an assembled position according to exemplary embodiments of the present disclosure.

Turning especially to FIGS. 9, 10, and 14, various perspective views are provided to illustrate an exemplary slide clamp 216, both in isolation (FIGS. 9 and 10) and through a corresponding clamp aperture 214 (FIG. 14). As shown, slide clamp 216 extends generally along the transverse direction T from a base end 218 to a distal free end 220. Base end 218 is fixed to first mounting flange 210. Distal free end 220 is spaced apart from first mounting flange 210 and, for instance, is relatively unencumbered or unconnected to any separate feature. Overall, the slide clamp 216 is a nonplanar (i.e., not flat) member that is not parallel to the reference plane P. In some embodiments, base end 218 and distal free end 220 are provided at separate vertical heights. Thus, slide clamp 216 may further extend generally along the vertical direction V. When assembled, slide clamp 216 may extend generally along the vertical direction V toward second mounting flange 212 such that the assembled clamping joint 106 provides slide clamp 216 extending through clamp aperture 214 such that clamp aperture 214 is positioned between base end 218 and distal free end 220 along the vertical direction V. In embodiments wherein first mounting flange 210 is positioned below second mounting flange 212, base end 218 may be positioned below second mounting flange 212 while distal free end 220 is positioned above second mounting flange 212.

Between base end 218 and distal free end 220, slide clamp 216 may include one or more discrete, bent segments (e.g., defining a nonparallel angle relative to the reference plane P). In some embodiments, slide clamp 216 includes a vertical lead-in segment 222 that extends along (e.g., within 10° of) the vertical direction V. In other words, vertical lead-in segment 222 may be substantially perpendicular relative to the reference plane P. As shown, vertical lead-in segment 222 extends from distal free end 220. For instance, the slides clamp may terminate at distal free end 220 with vertical lead-in segment 222. Thus, distal free end 220 may be defined as an extreme or tip of vertical lead-in segment 222.

In additional or alternative embodiments, slide clamp 216 includes a compression ramp segment 224 that defines a nonparallel ramp angle θ relative to the reference plane P (e.g., relative to the transverse direction T). Generally, compression ramp segment 224 is provided between base end 218 and distal free end 220. Specifically, at a location between base end 218 and distal free end 220, compression ramp segment 224 is defined between a guide surface 226 and an engagement surface 228. As shown, guide surface 226 is positioned distal to first mounting flange 210 while the engagement surface 228 is positioned proximal to first mounting flange 210. In other words, guide surface 226 is further apart from first mounting flange 210 than the engagement surface 228 is (e.g., measured relative to or along the vertical direction V). In some such embodiments, compression ramp segment 224 extends immediately from vertical lead-in segment 222. For instance, guide surface 226 may be defined at a transition between vertical lead-in segment 222 in compression ramp segment 224. The nonparallel ramp angle θ defined between guide surface 226 and the engagement surface 228 is both nonparallel and nonperpendicular relative to the transverse direction T. For instance, the nonparallel ramp angle θ may be between 5° and 60° relative to the transverse direction T.

In further additional or alternative embodiments, slide clamp 216 includes a resilient arcuate segment 230 that extends from base end 218 to engagement surface 228. Generally, resilient arcuate segment 230 includes one or more vertical turns or inflection points 232 between base end 218 and engagement surface 228 (e.g., along the transverse direction T). In other words, as tracked along the transverse direction T from base end 218, at least a portion of resilient arcuate segment 230 may extend generally along the vertical direction V away from first mounting flange 210 before returning or descending back towards first mounting flange 210. For instance, resilient arcuate segment 230 may form a generally U-shaped or V-shaped member from base end 218 to engagement surface 228. Resilient arcuate segment 230 may extend directly from first mounting flange 210. For instance, resilient arcuate segment 230 (e.g., or the entirety of slide clamp 216) may be formed as an integral (e.g., unitary monolithic) member with first mounting flange 210.

During use or assembly, resilient arcuate segment 230 may serve as an elastic biasing arm holding second mounting flange 212 against first mounting flange 210. When assembled, engagement surface 228 may contact or be held against a top surface of second mounting flange 212 (e.g., such that at least a portion of second mounting flange 212 is held between engagement surface 228 and first mounting flange 210). Moreover, engagement surface 228 (e.g., as supported by resilient arcuate segment 230) may urge or bias second mounting flange 212 toward first mounting flange 210.

Between base end 218 and distal free end 220, slide clamp 216 defines a maximum clamp width 234 (e.g., along the lateral direction L). In some embodiments, the maximum clamp width 234 is defined at engagement surface 228. In additional or alternative embodiments, the maximum clamp width 234 is a constant lateral width maintained across multiple segments (e.g., resilient arcuate segment 230, compression ramp segment 224, or vertical lead-in segment 222). For instance, the maximum clamp width 234 may be maintained from base end 218 through resilient arcuate segment 230, compression ramp segment 224, and at least a portion of vertical lead-in segment 222.

In optional embodiments, a pair of lateral guide chamfers 236 are provided on at least a portion of vertical lead-in segment 222. Specifically, the pair of lateral guide chamfers 236 may extend from distal free end 220 and, for example, terminate at the maximum clamp width 234. Lateral guide chamfers 236 may be angled toward each other and define a decreasing or tapered clamp width of slide clamp 216. For instance, each guide chamfer may extend generally along the vertical direction V and the lateral direction L (e.g., irrespective of a plane defined by the transverse direction T and the vertical direction V). Thus, lateral guide chamfers 236 may form a lateral taper that terminates at an extreme of vertical lead-in segment 222 and slide clamp 216.

As shown, slide clamp 216 may be formed (e.g., stamped, pierced, lance-formed, molded, etc.) from the same base material as first mounting flange 210 such that a gap or hole is left in first mounting flange 210 (i.e., a void is left where the material of slide clamp 216 originally existed). Nonetheless, in alternative embodiments, slide clamp 216 is formed separately from first mounting flange 210 and then later attached (e.g., via one or more adhesive, weld, or mechanical fastener) to first mounting flange 210 (e.g., such that no holes or gap is formed in first mounting flange 210).

Figure 13:
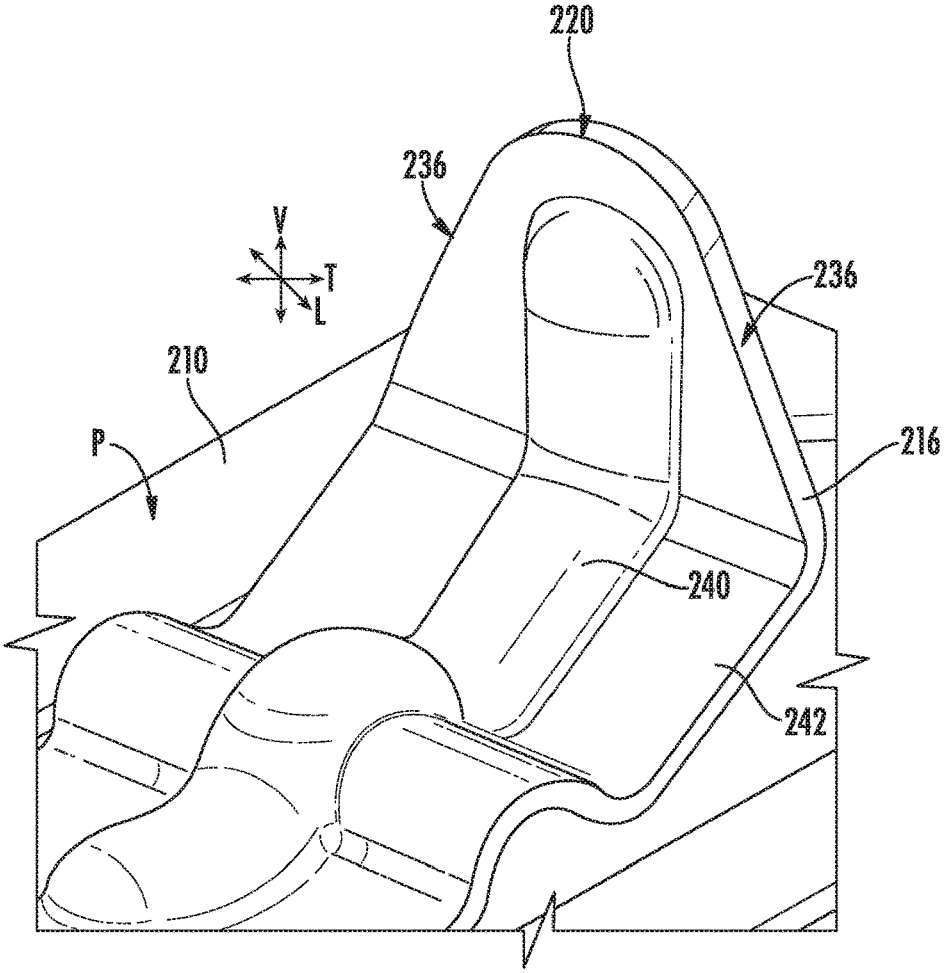
FIG. 13 provides a perspective view of a first mounting flange, in isolation, according to exemplary embodiments of the present disclosure.

As shown in FIG. 9, slide clamp 216 may be formed to have an unbent lateral profile or uniform thickness (e.g., equal to a maximum clamp thickness 238 between two opposing surfaces). However, turning briefly to FIG. 13, it is understood that alternative embodiments may include variations in the lateral profile, such as a profile bead is formed and defines an embossed rib 240 (e.g., surrounded by an otherwise flat lateral profile 242) extending along at least a portion of the transverse length 246 of slide clamp 216 between base end 218 and distal free end 220. In some such embodiments, the rigidity (e.g., resistance to lateral deformation) or overall clamping force of slide clamp 216 is advantageously increased.

Figure 11:
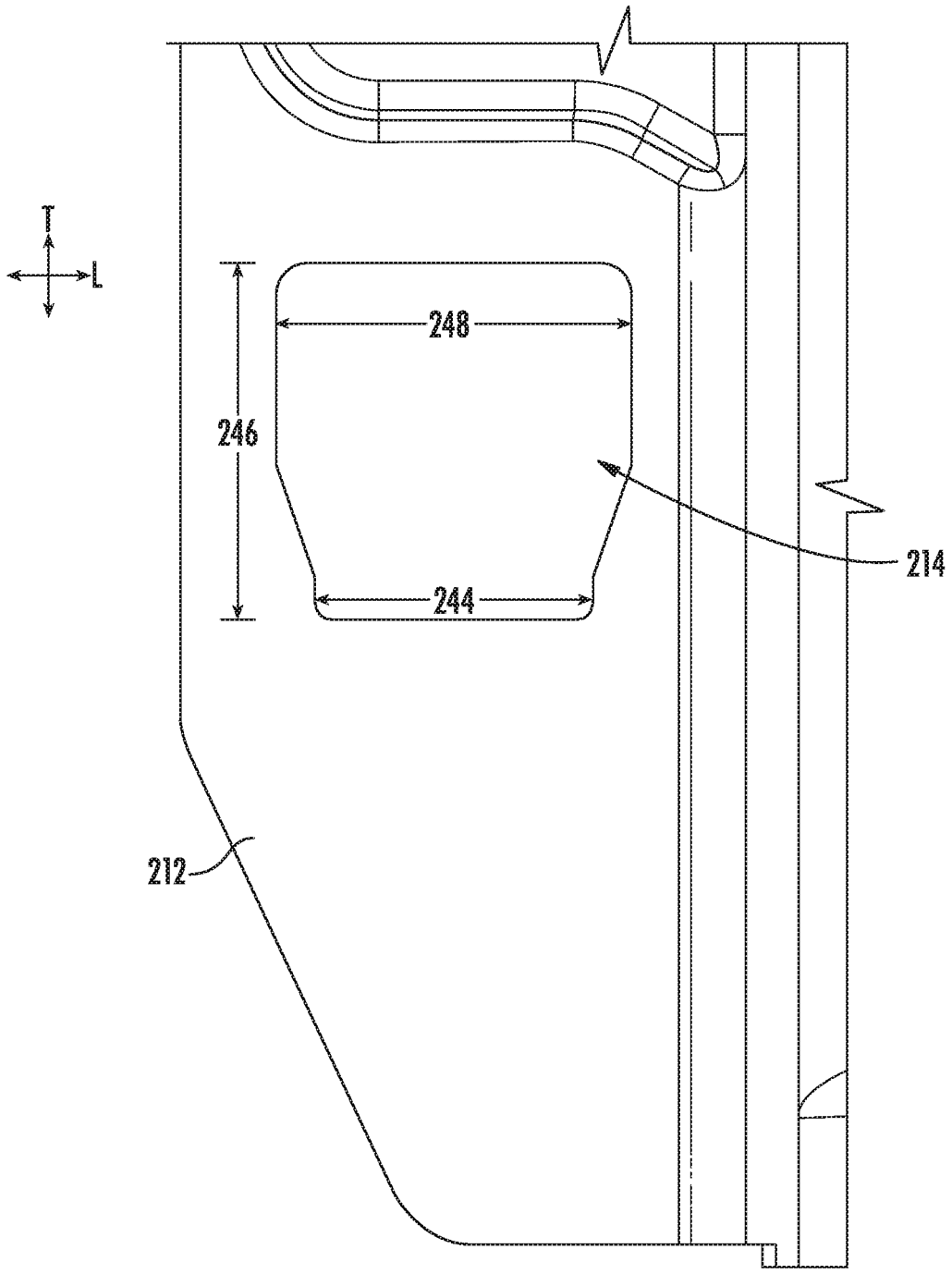
FIG. 11 provides a top perspective view of a second mounting flange, in isolation, of the exemplary heater assembly of FIG. 3.

Turning now especially to FIG. 11, an overhead view of a portion of second mounting flange 212, including a clamp aperture 214 defined thereby, is provided. Generally, clamp aperture 214 extends fully through second mounting flange 212 (e.g., along the vertical direction V) and is shaped to receive slide clamp 216. Clamp aperture 214 defines a transverse length 246 that is greater than or equal to the thickness (e.g., maximum clamp thickness 238) of slide clamp 216. Thus, when assembled, at least a portion of slide clamp 216 is permitted to extend through clamp aperture 214 along the vertical direction V. Optionally, clamp aperture 214 is parallel to the vertical direction V (e.g., such that clamp aperture 214 does not taper relative to the vertical direction V when assembled).

In some embodiments, clamp aperture 214 defines a minimum aperture width 244 (e.g., along the lateral direction L) that is equal to or greater than the maximum clamp width 234 of slide clamp 216. In other words, the maximum clamp width 234 may be less than the minimum aperture width 244. In optional embodiments, clamp aperture 214 further defines a maximum aperture width 248 (along the lateral direction L) that is greater than the minimum aperture width 244. As shown, clamp aperture 214 may taper laterally (e.g., along the transverse direction T) between the maximum aperture width 248 and the minimum aperture width 244.

Figure 12A:
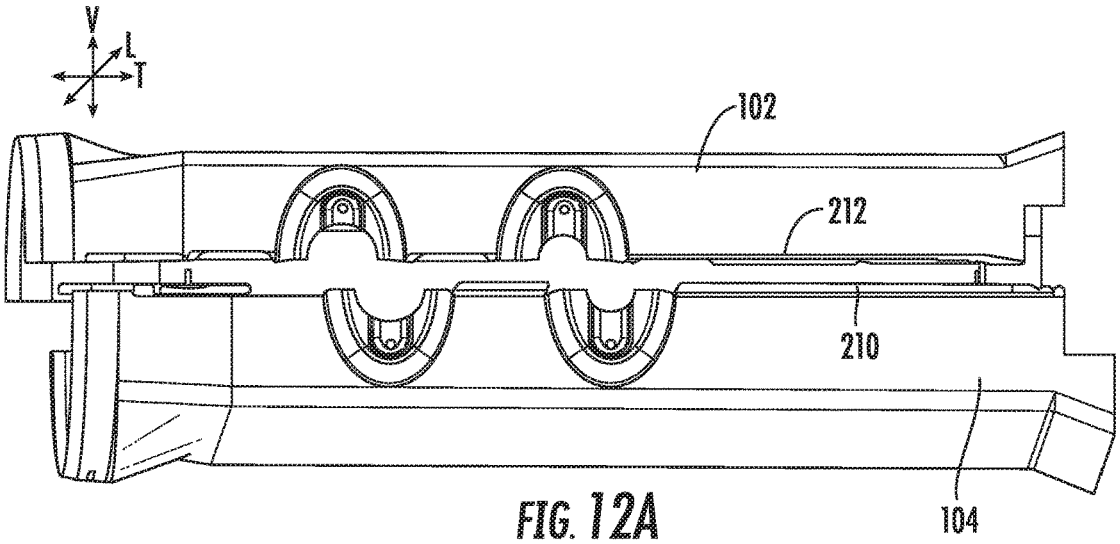
FIG. 12A provides a perspective view of an exemplary housing of a heater assembly in a first position.
Figure 12B:
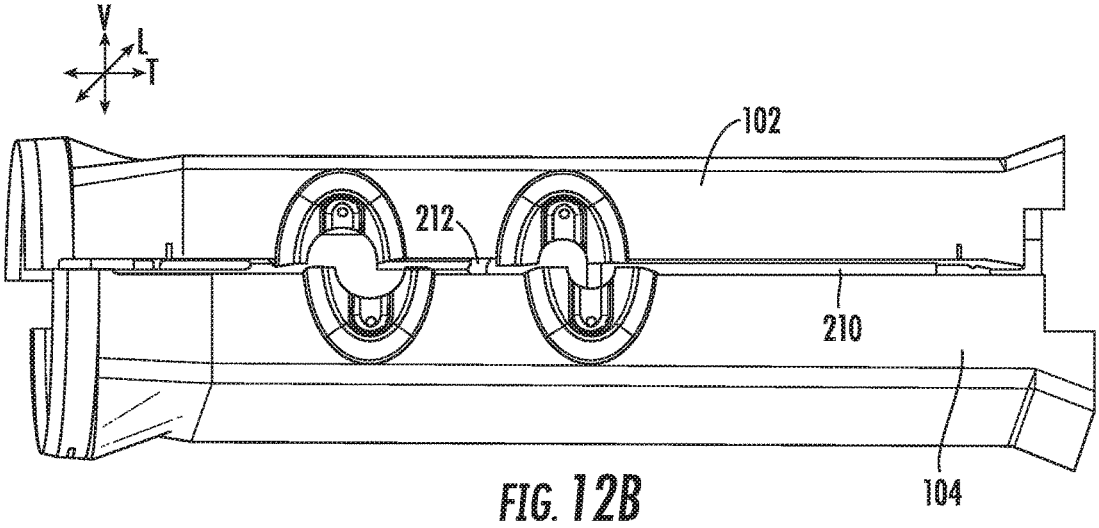
FIG. 12B provides a perspective view of an exemplary housing of a heater assembly in a second position.
Figure 12C:
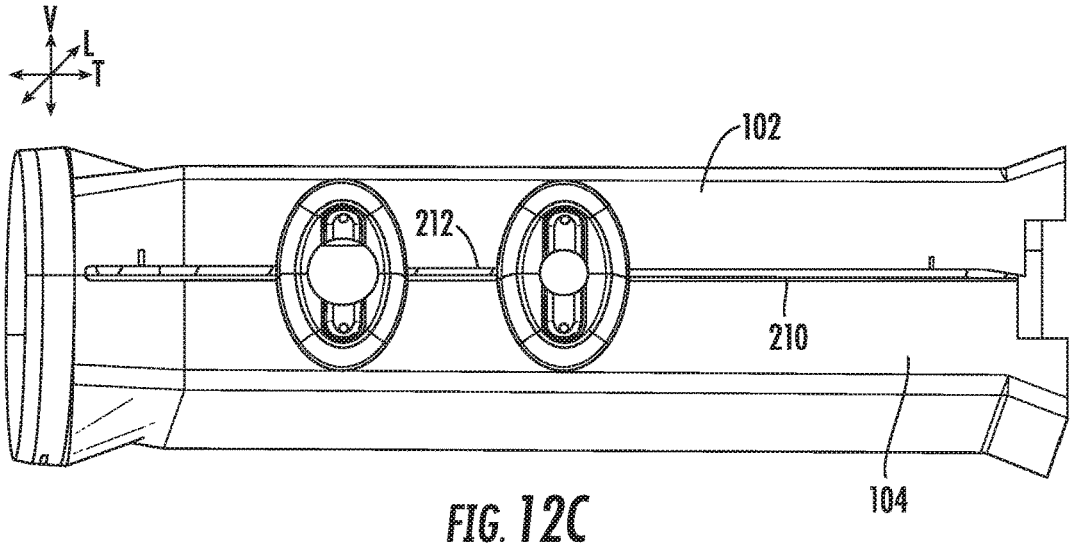
FIG. 12C provides a perspective view of an exemplary housing of a heater assembly in a third position.

Turning now to FIGS. 12A through 12C, relative movement for the assembly of upper housing portion 102 and lower housing portion 104 is generally illustrated. As illustrated in FIG. 12A, prior to assembly, upper housing portion 102 and lower housing portion 104 may be staggered along the transverse direction T and separated along the vertical direction V (e.g., in an unassembled or first position). In such a position, upper housing portion 102 and lower housing portion 104 may be laterally aligned. Moreover, at least a portion of a slide clamp 216 and a corresponding clamp aperture 214 may be vertically aligned (e.g., such that upper housing portion 102 or lower housing portion 104 may be moved vertically into a partially-assembled or second position—FIG. 12B).

As illustrated in FIG. 12B, in the second position, upper housing portion 102 and lower housing portion 104 may remain staggered along the transverse direction T while being in vertical contact. Vertical movement will remain unrestricted as no portion of slide clamp 216 extends over second mounting flange 212 (e.g., along the transverse direction T). From the second position, upper housing portion 102 and a lower housing portion 104 may be moved relative to each other along the transverse direction T to an assembled or third position (FIG. 12C)

As illustrated in FIG. 12C. In the third position, at least a portion of slide clamp 216 (e.g., engagement surface 228) is held over a portion of second mounting flange 212 (e.g., along the transverse direction T) such that second mounting flange 212 is urged or biased toward first mounting flange 210 and vertical movement of first mounting flange 210 relative to second mounting flange 212 is restricted (see also FIG. 14).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A heater assembly for an appliance, the heater assembly comprising:

a housing comprising a first housing portion and a second housing portion selectively secured to the first housing portion, the first and second housing portions defining a chamber, the first and second housing portions also defining an inlet and an outlet, the chamber extending along an axial direction from the inlet to the outlet;

a first mounting flange extending radially from the first housing portion to define a first reference plane having a mutually-orthogonal vertical direction, lateral direction, and transverse direction, the transverse direction being parallel to the axial direction;

a second mounting flange extending radially from the second housing portion and slidably positioned on the first mounting flange, the second mounting flange defining a clamp aperture extending therethrough along the vertical direction; and a slide clamp extending through the clamp aperture and generally along the transverse direction from a base end fixed to the first mounting flange to a distal free end, the base end being positioned below the second mounting flange, and the distal free end being positioned above the second mounting flange, wherein the slide clamp comprises a vertical lead-in segment extending from the free end along the vertical direction, and a compression ramp segment defining a non-parallel angle relative to the transverse direction between the base end and the distal free end.

2. The heater assembly of claim 1, further comprising a heating element disposed within the chamber to heat an airflow from the inlet to the outlet.

3. The heater assembly of claim 1, wherein the slide clamp comprises a resilient arcuate segment extending from the base end to an engagement surface between the base end and the distal free end, the engagement surface disposed above the second mounting flange and biasing the second mounting flange toward the first mounting flange.

4. The heater assembly of claim 1, wherein the slide clamp defines a pair of lateral guide chamfers extending from the distal free end.

5. The heater assembly of claim 1, wherein the clamp aperture tapers laterally along the transverse direction from a maximum aperture width to a minimum aperture width, wherein the slide clamp defines a maximum clamp width along the lateral direction, and wherein the maximum clamp width is less than the minimum aperture width.

6. The heater assembly of claim 1, wherein the first mounting flange comprises a left and right pair of first mounting flanges at opposite sides of the housing, and wherein the second mounting flange comprises a left and right pair of second mounting flanges at the opposite sides of the housing.

7. The heater assembly of claim 1, further comprising a thermostat mounted to the housing between the first housing portion and the second housing portion, the thermostat comprising a probe positioned within the chamber.

8. A dryer appliance, comprising:

a cabinet defining an interior;

a drum positioned within the interior, the drum defining a chamber for receipt of articles for drying; and a heater assembly mounted within the cabinet in fluid communication with the drum to heat air thereto, the heater assembly comprising a housing comprising a first housing portion and a second housing portion selectively secured to the first housing portion, the first and second housing portions defining a chamber, the first and second housing portions also defining an inlet and an outlet, the chamber extending along an axial direction from the inlet to the outlet, a first mounting flange extending radially from the first housing portion to define a first reference plane having a mutually-orthogonal vertical direction, lateral direction, and transverse direction, the transverse direction being parallel to the axial direction, a second mounting flange extending radially from the second housing portion and slidably positioned on the first mounting flange, the second mounting flange defining a clamp aperture extending therethrough along the vertical direction, and a slide clamp extending through the clamp aperture and generally along the transverse direction from a base end fixed to the first mounting flange to a distal free end, the base end being positioned below the second mounting flange, and the distal free end being positioned above the second mounting flange, wherein the slide clamp comprises a vertical lead-in segment extending from the free end along the vertical direction, and a compression ramp segment defining a non-parallel angle relative to the transverse direction between the base end and the distal free end.

9. The dryer appliance of claim 8, wherein the heater assembly further comprises a heating element disposed within the chamber to heat an airflow from the inlet to the outlet.

10. The dryer appliance of claim 8, wherein the slide clamp comprises a resilient arcuate segment extending from the base end to an engagement surface between the base end and the distal free end, the engagement surface disposed above the second mounting flange and biasing the second mounting flange toward the first mounting flange.

11. The dryer appliance of claim 8, wherein the slide clamp defines a pair of lateral guide chamfers extending from the distal free end.

12. The dryer appliance of claim 8, wherein the clamp aperture tapers laterally along the transverse direction from a maximum aperture width to a minimum aperture width, wherein the slide clamp defines a maximum clamp width along the lateral direction, and wherein the maximum clamp width is less than the minimum aperture width.

13. The dryer appliance of claim 8, wherein the first mounting flange comprises a left and right pair of first mounting flanges at opposite sides of the housing, and wherein the second mounting flange comprises a left and right pair of second mounting flanges at the opposite sides of the housing.

14. The dryer appliance of claim 8, wherein the heater assembly further comprises a thermostat mounted to the housing between the first housing portion and the second housing portion, the thermostat comprising a probe positioned within the chamber.

15. A dryer appliance, comprising:

a cabinet defining an interior;

a drum positioned within the interior, the drum defining a chamber for receipt of articles for drying; and a heater assembly mounted within the cabinet in fluid communication with the drum to heat air thereto, the heater assembly comprising a housing comprising a first housing portion and a second housing portion selectively secured to the first housing portion, the first and second housing portions defining a chamber, the first and second housing portions also defining an inlet and an outlet, the chamber extending along an axial direction from the inlet to the outlet, a first mounting flange extending radially from the first housing portion to define a first reference plane having a mutually-orthogonal vertical direction, lateral direction, and transverse direction, the transverse direction being parallel to the axial direction, a second mounting flange extending radially from the second housing portion and slidably positioned on the first mounting flange, the second mounting flange defining a clamp aperture extending therethrough along the vertical direction, and a slide clamp extending through the clamp aperture and generally along the transverse direction from a base end fixed to the first mounting flange to a distal free end, the base end being positioned below the second mounting flange, and the distal free end being positioned above the second mounting flange, wherein the slide clamp comprises a vertical lead-in segment extending from the free end along the vertical direction, a compression ramp segment defining a non-parallel angle relative to the transverse direction between the base end and the distal free end, and a resilient arcuate segment extending from the base end to an engagement surface between the base end and the distal free end, the engagement surface disposed above the second mounting flange and biasing the second mounting flange toward the first mounting flange, wherein the slide clamp defines a pair of lateral guide chamfers extending from the distal free end.

16. The dryer appliance of claim 15, wherein the clamp aperture tapers laterally along the transverse direction from a maximum aperture width to a minimum aperture width, wherein the slide clamp defines a maximum clamp width along the lateral direction, and wherein the maximum clamp width is less than the minimum aperture width.

17. The dryer appliance of claim 15, wherein the first mounting flange comprises a left and right pair of first mounting flanges at opposite sides of the housing, and wherein the second mounting flange comprises a left and right pair of second mounting flanges at the opposite sides of the housing.

18. The dryer appliance of claim 15, wherein the heater assembly further comprises a thermostat mounted to the housing between the first housing portion and the second housing portion, the thermostat comprising a probe positioned within the chamber.

* * * * *